US006047523A

United States Patent [19]

Eyre et al.

[11] Patent Number: 6,047,523

[45] Date of Patent: Apr. 11, 2000

[54] VERTICAL PACKAGING OF WEBBING ROLLS

[75] Inventors: Michael R. Eyre, Farmington, N.Y.; James R. Gavin, Lake Forest, Ill.; Keith A. Jackson, Gurnee, Ill.; Mark W. Palzer, Lake Villa, Ill.; Matthew A. Roth, Pittsford, N.Y.

[73] Assignee: Tenneco Packaging Inc., Lake Forest, Ill.

[21] Appl. No.: 09/040,495

[22] Filed: Mar. 18, 1998

[51] Int. Cl.[7] ..... B65B 53/00; B65B 13/02

[52] U.S. Cl. ..... 53/399; 53/397; 53/441; 53/415; 206/597; 206/391

[58] Field of Search ..... 53/399, 441, 445, 53/415, 156, 157, 139.5, 139.6, 139.7, 397; 206/597, 391

[56] References Cited

U.S. PATENT DOCUMENTS

| | | | |
|---|---|---|---|
| 1,808,651 | 6/1931 | Gibb et al. . | |
| 2,185,920 | 1/1940 | Martin | 206/65 |
| 2,326,928 | 8/1943 | Courson | 206/65 |
| 2,570,340 | 10/1951 | George | 206/65 |
| 2,583,673 | 1/1952 | Storey | 229/40 |
| 2,610,735 | 9/1952 | Ferguson | 206/65 |
| 3,109,540 | 11/1963 | Klimpl | 206/65 |
| 3,249,412 | 5/1966 | Kolek et al. | 65/3 |
| 3,410,394 | 11/1968 | Jackson et al. | 206/59 |
| 3,436,893 | 4/1969 | Vokes et al. | 53/415 |
| 3,638,790 | 2/1972 | Schmid et al. | 206/65 S |
| 3,835,986 | 9/1974 | LeBeau | 206/320 |
| 3,850,294 | 11/1974 | Phillips et al. | 206/205 |
| 3,915,301 | 10/1975 | Gray et al. | 206/409 |
| 3,954,219 | 5/1976 | Mangini et al. | 229/23 A |
| 4,097,004 | 6/1978 | Reese | 242/129.72 |
| 4,141,447 | 2/1979 | Anderson | 206/392 |
| 4,142,634 | 3/1979 | Leff et al. | 206/392 |
| 4,147,253 | 4/1979 | Brook et al. | 206/205 |
| 4,201,138 | 5/1980 | Cox | 108/55.1 |
| 4,202,448 | 5/1980 | Jaeger et al. | 206/392 |
| 4,247,021 | 1/1981 | Renier et al. | 222/143 |
| 4,292,901 | 10/1981 | Cox | 108/55.1 |
| 4,435,479 | 3/1984 | Pivoteau et al. | 428/542.8 |
| 4,444,311 | 4/1984 | Rias | 206/391 |
| 4,516,677 | 5/1985 | Rowland et al. | 206/394 |
| 4,546,880 | 10/1985 | Reese | 206/410 |
| 4,595,093 | 6/1986 | Eckstein | 206/44 R |
| 4,667,823 | 5/1987 | Wolfe, Jr. et al. | 206/392 |
| 4,762,750 | 8/1988 | Girgis et al. | 428/378 |
| 4,762,751 | 8/1988 | Girgis et al. | 428/378 |
| 4,897,980 | 2/1990 | Geyser et al. | 53/139.7 X |

(List continued on next page.)

*Primary Examiner*—Linda Johnson
*Attorney, Agent, or Firm*—Arnold White & Durkee

[57] ABSTRACT

A system for the vertical packaging of webbing rolls comprises a bottom tray, a top cap, a plurality of webbing rolls, and stretch wrap film. The bottom tray includes a bottom wall and a plurality of side walls extending upwardly from the bottom wall. Likewise, the top cap includes a top wall and a plurality of side walls extending downward from the top wall. The webbing rolls are positioned between the bottom tray and the top cap with the webbing rolls resting on the bottom wall of the bottom tray and the top cap positioned atop the webbing rolls. Horizontally adjacent ones of the webbing rolls are in contact with each other. The contact between adjacent ones of the webbing rolls helps to maintain the integrity of the system during movement thereof. To reduce the amount of packaging material utilized in the system, neither the bottom tray nor the top cap includes corners joining their respective side walls. Rather, adjacent ones of the side walls of the bottom tray are secured to each other by fastening means such as tape, and adjacent ones of the side walls of the top cap are secured to each other in similar fashion. Moreover, the system is free of divider walls, sleeves, and boxes for isolating the webbing rolls from each other. The stretch wrap film is wrapped around the bottom tray, the webbing rolls, and the top cap to unitize the system.

14 Claims, 3 Drawing Sheets

U.S. PATENT DOCUMENTS

| | | | |
|---|---|---|---|
| 4,998,619 | 3/1991 | Sowa et al. | 206/392 |
| 5,147,040 | 9/1992 | Koike et al. | 206/410 |
| 5,344,014 | 9/1994 | Toral et al. | 206/394 |
| 5,363,962 | 11/1994 | Toral et al. | 206/394 |
| 5,396,990 | 3/1995 | Bell et al. | 206/391 |
| 5,409,114 | 4/1995 | Myers et al. | 206/394 |
| 5,531,327 | 7/1996 | Darby | 206/600 |
| 5,535,572 | 7/1996 | Morantz et al. | 53/139.7 |
| 5,551,563 | 9/1996 | Allen | 206/394 |
| 5,564,254 | 10/1996 | Thimon et al. | 53/139.6 X |
| 5,624,031 | 4/1997 | Fowler et al. | 206/391 |

VERTICAL PACKAGING OF WEBBING ROLLS

FIELD OF THE INVENTION

The present invention relates to a system for the vertical packaging of webbing rolls which provides adequate protection and stability to the rolls and, at the same time, minimizes the amount of packaging materials utilized in the system.

BACKGROUND OF THE INVENTION

Webbing rolls are wound rolls of film, sheet or other material that for the purposes of this invention must be shipped from a point of manufacture to an end user at a distant destination. The webbing material can be paper, plastic film, yarn or the like. No matter what type of material is shipped, there have been recurring problems with damage to the webbing material during transit. The damage is often encountered during shipment by common carrier. Moreover, existing systems for packaging of webbing rolls can utilize excessive amounts of packaging materials and, therefore, be expensive to manufacture.

An example of a system for packaging webbing rolls is proposed in U.S. Pat. No. 5,551,563 to Allen. The system includes a support base, a lid, and a plurality of generally cylindrical objects captured between the support base and the lid. The support base includes a bottom wall and four side walls extending upward from the bottom wall. The side walls intersect at four rounded corners. The lid has essentially the same structure as the support base, but is inverted relative to the base.

Although this system reduces the amount of packaging materials by eliminating divider walls between the cylindrical objects, the system still requires vertically-extended corners or corner protectors extending between corresponding corners of the support base and the lid. The extended corners or corner protectors are additional packaging materials that increase the cost of manufacturing the system. The system proposed by Allen also includes a retaining strap extending around the support base, the plurality of cylindrical objects, and the lid to purportedly maintain the integrity of the system during movement thereof. Although such a retaining strap likely provides some measure of integrity for the system, the measure of integrity could still be improved.

SUMMARY OF THE INVENTION

An object of the present invention to provide a system for the vertical packaging of webbing rolls which provides adequate protection and stability to the rolls and, at the same time, minimizes the amount of packaging materials utilized in the system.

These and other objects are realized by providing a system for the vertical packaging of webbing rolls. The system comprises a bottom tray, a top cap, a plurality of webbing rolls, and stretch wrap film. The bottom tray includes a bottom wall and a plurality of side walls extending upwardly from the bottom wall. Likewise, the top cap includes a top wall and a plurality of side walls extending downward from the top wall. The webbing rolls are positioned between the bottom tray and the top cap with the webbing rolls resting on the bottom wall of the bottom tray and the top cap positioned atop the webbing rolls. Horizontally adjacent ones of the webbing rolls are in contact with each other. If the webbing material on the webbing rolls is plastic film such as stretch wrap film, the webbing rolls tend to maintain this contact because the plastic film on one webbing roll is attracted to the plastic film on adjacent webbing rolls. The contact between adjacent ones of the webbing rolls helps to maintain the integrity of the system during movement thereof.

To reduce the amount of packaging material utilized in the system and to more easily adapt the system to webbing rolls of different sizes, neither the bottom tray nor the top cap includes corners joining their respective side walls. Rather, adjacent ones of the side walls of the bottom tray are secured to each other by fastening means such as tape, and adjacent ones of the side walls of the top cap are secured to each other in similar fashion. Moreover, the system is free of divider walls, sleeves, and boxes for isolating the webbing rolls from each other.

The bottom tray, the top cap, and the webbing rolls are preferably supported by a pallet. Starting from this pallet, the stretch wrap film is spirally wound about the bottom tray, the webbing rolls, and then the top cap to stabilize the load and help maintain the integrity of the system during movement thereof.

The plurality of webbing rolls may include one or more tiers of such rolls. If, for example, the plurality of webbing rolls includes two tiers of such rolls, then the webbing rolls of the upper tier are stacked on top of the corresponding webbing rolls of the lower tier. A flat horizontal sheet may be placed between the tiers of webbing rolls.

Instead of using multiple tiers of webbing rolls in one system, each tier of webbing rolls can be associated with its own system. Specifically, a first system can include a first bottom tray, a first top cap, and a tier of first webbing rolls, and a second system can include a second bottom tray, a second top cap, and a tier of second webbing rolls. The second system is then stacked on top of the first system with the bottom tray of the second system resting on the top cap of the first system. Stretch wrap film is wrapped around both the first and second systems to unitize the two systems into a single load.

BRIEF DESCRIPTION OF THE DRAWINGS

Other objects and advantages of the invention will become apparent upon reading the following detailed description and upon reference to the drawings in which.

Figure 1:
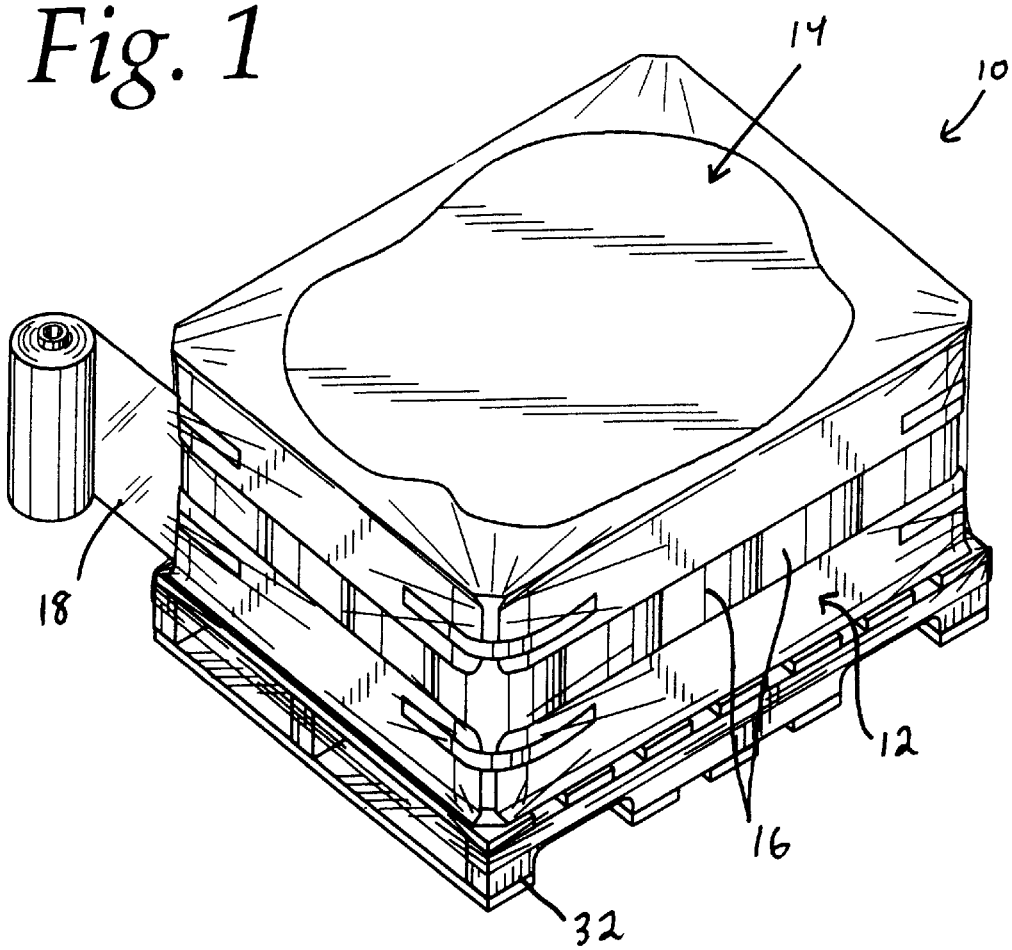
FIG. 1 is an isometric view of an assembled system for the vertical packaging of webbing rolls.
Figure 2:
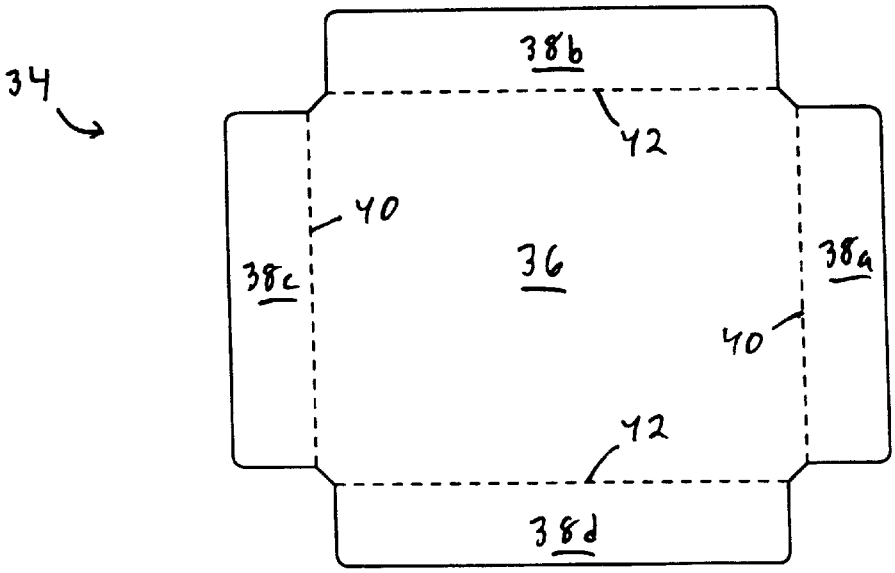
FIG. 2 is a top plan view of a blank used to form either a bottom tray or top cap used in the assembled system of FIG. 1.

While the invention is susceptible to various modifications and alternative forms, a specific embodiment thereof has been shown by way of example in the drawings and will herein be described in detail. It should be understood, however, that it is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Figure 3:
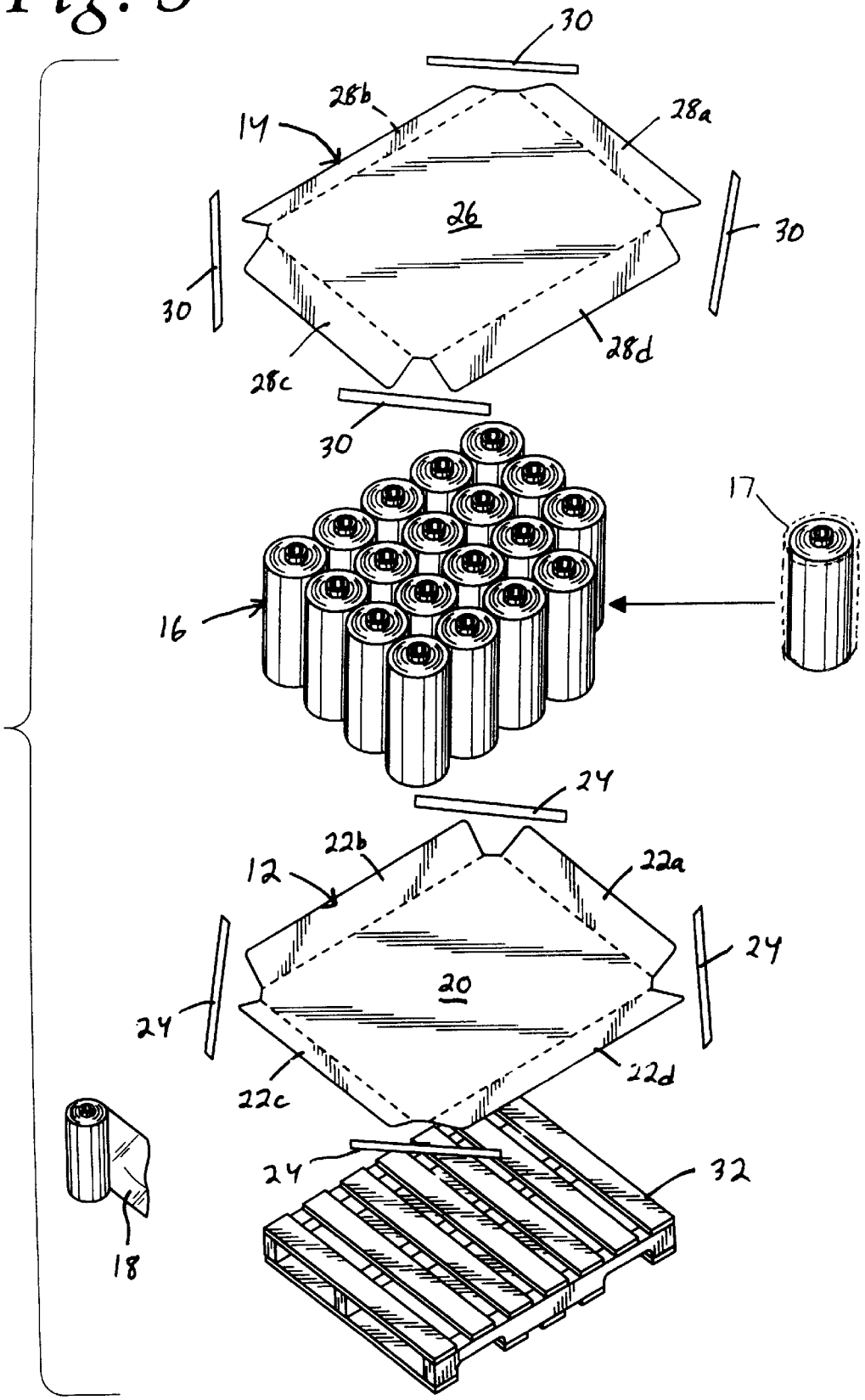
FIG. 3 is an exploded isometric view of the system for the vertical packaging of webbing rolls.
Figure 4:
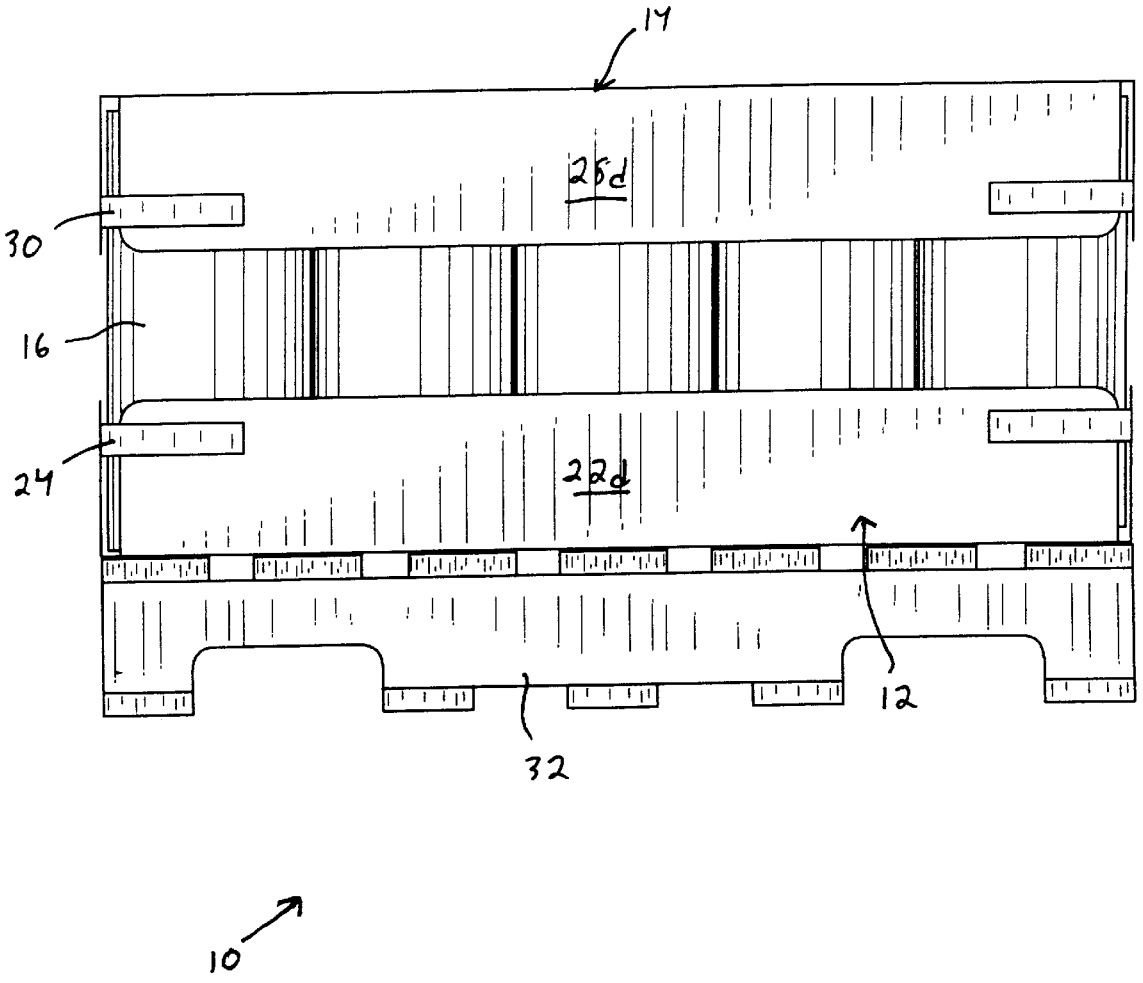
FIG. 4 is a side elevational view of the assembled system of FIG. 1.

Turning now to the drawings, FIGS. 1, 3, and 4 depict a system 10 for the vertical packaging of webbing rolls. The system 10 comprises a bottom tray 12, a top cap 14, a plurality of webbing rolls 16, and thermoplastic stretch wrap film 18. The bottom tray 12 includes a bottom wall 20 and a plurality of side walls 22*a–d* extending upwardly from the bottom wall 20. Likewise, the top cap 14 includes a top wall 26 and a plurality of side walls 28*a–d* extending downward from the top wall 26. The webbing rolls 16 are positioned between the bottom tray 12 and the top cap 14 with the webbing rolls 16 resting on the bottom wall 20 of the bottom tray 12 and the top cap 14 positioned atop the webbing rolls 16.

Each of the webbing rolls 16 has a rigid center core extending beyond each end of the wound webbing material. As a result, when the center core rests on the bottom tray 12, the center core carries the weight of the webbing roll and maintains the webbing material a spaced distance from the bottom tray 12. When the top cap 14 is positioned atop the webbing rolls 16, the top cap 14 is in contact with and supported by the rigid center cores so that the webbing material is maintained a spaced distance from the top cap 14.

Horizontally adjacent ones of the webbing rolls 16 are in contact with each other. If the webbing material on the webbing rolls 16 is plastic film such as stretch wrap film, the webbing rolls 16 tend to maintain this contact because the plastic film on one webbing roll is attracted to the plastic film on adjacent webbing rolls. The contact between adjacent ones of the webbing rolls 16 helps to maintain the integrity of the system 10 during movement thereof.

To reduce the amount of packaging material utilized in the system 10, neither the bottom tray 12 nor the top cap 14 includes corners joining their respective side walls. Rather, adjacent ones of the side walls 22*a–d* of the bottom tray 12 are secured to each other by fastening means such as tape strips 24, and adjacent ones of the side walls 28*a–d* of the top cap 14 are secured to each other by fastening means such as tape strips 30. Moreover, the system 10 is preferably free of divider walls, sleeves, and boxes for isolating the webbing rolls 16 from each other. The absence of divider walls, sleeves, and boxes results in a material savings which, in turn, reduces the cost of manufacturing the system 10.

Each webbing roll 16 or alternate ones of the webbing rolls 16 may nonetheless be individually wrapped with polyethylene or polypropylene foam if desired. The wrapped foam is secured in place using tape or the like. One such piece of wrapped foam is shown in dotted lines in FIG. 3 and is identified by reference numeral 17. It should be undestood that if such wrapped foam is employed, each webbing roll or alternate ones of the webbing rolls in FIG. 3 would be wrapped with such foam in similar fashion.

The bottom tray 12, the top cap 14, and the webbing rolls 16 are preferably supported by a pallet 32. Starting from this pallet 32, the stretch wrap film 18 is spirally wound about the bottom tray 12, the webbing rolls 16, and then the top cap 14 to stabilize and tighten the load and help maintain the integrity of the system 10 during movement thereof. The stretch wrap film 18 is wound sufficiently tight about the foregoing items to force the webbing rolls 16 into contact with one another. Thereafter, the contact between adjacent webbing rolls 16 is reinforced by the tackiness of the rolls or the friction between adjacent rolls and by the pressure applied to the rolls 16 by the stretch wrap film 18. The tackiness or friction of the webbing rolls 16 themselves, combined with the pressure applied by the stretch wrap film 18, increases the unitization and rigidity of the system 10.

Although FIGS. 1, 3, and 4 only depict a single tier of webbing rolls 16, the plurality of webbing rolls 16 may include additional tiers of such rolls. The number of webbing rolls in a tier and the number of tiers making up a unitized load will vary with the characteristics such as the weight and the dimensions of the rolls to be shipped. If, for example, the plurality of webbing rolls 16 includes two tiers of such rolls, then the webbing rolls of the upper tier are stacked on top of the corresponding webbing rolls of the lower tier. A flat horizontal sheet may be placed between the tiers of webbing rolls. The center cores of the webbing rolls in the upper tier are preferably aligned with the center cores of the corresponding webbing rolls in the lower tier.

Instead of using multiple tiers of webbing rolls in one system, each tier of webbing rolls can be associated with its own system. Specifically, a first system 10 can include a first bottom tray 12, a first top cap 14, and a tier of first webbing rolls 16, and a second system (not shown) can include a second bottom tray, a second top cap, and a tier of second webbing rolls. The second system is then stacked on top of the first system 10 with the bottom tray of the second system resting on the top cap 14 of the first system 10. Stretch wrap film is wrapped around both the first and second systems to unitize the two systems into a single load. To help cushion the lower first system 10 from the weight of the upper second system, a die-cut flat rectangular pad having approximately the same size and shape as the top wall 26 may be inserted between the upper ends of the webbing rolls 16 and the lower surface of the top wall 26.

The bottom tray 12 and the top cap 14 are identical in construction. In the assembled system 10, the top cap 14 is merely inverted relative to the bottom tray 12. FIG. 3 depicts a blank 34 for forming either the bottom tray 12 or the top cap 14. The blank 34 includes a central rectangular panel 36 and four peripheral flaps 38*a–d*. The flaps 38*a* and 38*c* are hingedly connected to the central panel 36 along the opposing vertical fold lines 40, while the flaps 38*b* and 38*d* are hingedly connected to the central panel 36 along the opposing horizontal fold lines 42.

To form the bottom tray 12 or the top cap 14 from the blank 34, the flaps 38*a–d* are folded perpendicular to the central panel 36. If the blank 34 is used to form the bottom tray 12, the central panel 36 and the peripheral flaps 38*a–d* serve as the bottom wall 20 and the side walls 22*a–d*, respectively. If the blank 34 is used to form the top cap 14, the central panel 36 and the peripheral flaps 38*a–d* serve as the top wall 26 and the side walls 28*a–d*, respectively. To maintain the blank 34 in the folded position, adjacent ones of the peripheral flaps 38*a–d* are connected by the tape strips 24 in the case of the bottom tray 12 and by the tape strips 30 in the case of the top cap 14 (see FIG. 3).

To assemble the system 10 from the components illustrated in FIG. 3, a blank 34 is folded and taped to form a bottom tray 12, the folded bottom tray 12 is placed on the pallet 32, and the webbing rolls 16 are placed on the bottom tray 12 with adjacent webbing rolls contacting each other. Alternatively, the bottom tray 12 may be folded and secured with the tape strips 24 after the webbing rolls 16 are placed on the bottom wall 20 of the bottom tray 12. Next, another blank 34 is folded and taped to form a top cap 14, and the folded top cap 14 is placed on top of the webbing rolls 16.

Finally, the load consisting of the pallet 32, the bottom tray 12, the webbing rolls 16, and the top cap 14 are transported to a stretch wrapping station. At the stretch wrapping station, the load is positioned upon a platform or turntable and a free end of the stretch wrap film 18 is tied to a corner of the pallet 32. The turntable is then made to rotate and, in so doing, to take up the stretch wrap film 18 supplied from a continuous roll. Braking tension is applied so that the film roll is continuously subjected to a stretching or tensioning force as it spirally wraps around the rotating load in overlapping layers. The stretch wrap film 18 is preferably wound in a generally horizontal direction with a gradual change in the vertical direction. Rotational speeds of from about five (5) to fifty (50) revolutions per minute are common. At the completion of the overwrap operation, the turntable is completely stopped and the film is cut and attached to an underlying layer of film employing tack sealing, adhesive tape, spray adhesives, or the like. The unitized load consisting of at least one tier secured to the pallet 32 is then ready for shipment.

The bottom tray 12 and the top cap 14 are composed of lightweight materials such as corrugated paper or paperboard. Corrugated paper offers several advantages. The structure of this material has inherent cushioning characteristics important to protecting the webbing rolls 16. Additionally, corrugated paper weighs less than the equivalent amount of plastic cradle packaging material required for horizontally packaging the same number of rolls into a unitized load. Corrugated paper is readily recyclable so that the end user's costs of disposal and volume of packaging material to be disposed are greatly reduced.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A system for vertical packaging of webbing rolls, comprising:

a bottom tray including a bottom wall and four first side walls extending upwardly from said bottom wall;

a top cap including a top wall and four second side walls extending downward from said top wall;

a plurality of vertically-oriented webbing rolls positioned between said bottom tray and said top cap, said webbing rolls resting on said bottom wall of said bottom tray, said top cap being positioned atop said webbing rolls, adjacent ones of said webbing rolls being in contact with each other;

wherein said bottom tray and said top cap are free of corners joining said first side walls and said second side walls;

a plurality of first fastening strips securing adjacent ones of said first side walls;

a plurality of second fastening strips securing adjacent ones of said second side walls; and thermoplastic stretch wrap film wrapped around said bottom tray, said webbing rolls, and said top cap to unitize said system.

2. The system of claim 1, wherein said second side walls are spaced from corresponding ones of said first side walls.

3. The system of claim 1, wherein said system is free of divider walls between adjacent ones of said webbing rolls.

4. The system of claim 1, wherein each of said webbing rolls include plastic film wound about a rigid center core.

5. The system of claim 1, wherein said first and second fastening strips further comprise tape strips.

6. The system of claim 1, further including a pallet supporting said bottom tray, said webbing rolls, and said top cap, and wherein said stretch wrap film is also wrapped around said pallet to unitize said pallet with said bottom tray, said webbing rolls, and said top cap.

7. The system of claim 6, wherein said stretch wrap film is spirally wound about said pallet, said bottom tray, said webbing rolls, and said top cap in generally horizontal overlapping layers.

8. The system of claim 1, wherein said bottom tray and said top cap are identical in construction and are each formed from a corresponding blank having a rectangular central panel and a plurality of peripheral flaps hingedly connected to respective edges of said central panel.

9. A method of forming a system for vertical packaging of webbing rolls, comprising the steps of:

forming a bottom tray including a bottom wall and four first side walls extending upwardly from said bottom wall;

forming a top cap including a top wall and four second side walls extending downward from said top wall wherein said bottom tray and said top cap are free of corners joining said first side walls and said second side walls;

securing adjacent ones of said first side walls with a plurality of first fastening strips;

securing adjacent ones of said second side walls with a plurality of second fastening strips;

loading a plurality of vertically-oriented webbing rolls on to said bottom wall of said bottom tray with adjacent ones of said webbing rolls in contact with each other;

placing said top cap atop said loaded webbing rolls; and wrapping thermoplastic stretch wrap film around said bottom tray, said webbing rolls, and said top cap to unitize said system.

10. The method of claim 9, wherein said second side walls are spaced from corresponding ones of said first side walls.

11. The method of claim 9, wherein said system is free of divider walls between adjacent ones of said webbing rolls.

12. The method of claim 9, wherein each of said webbing rolls include plastic film wound about a rigid center core.

13. The method of claim 9, further including the steps of supplying a pallet and placing said bottom tray on to said pallet, and wherein said step of wrapping said stretch wrap film includes wrapping said stretch wrap film around said pallet to unitize said pallet with said bottom tray, said webbing rolls, and said top cap.

14. The method of claim 13, wherein said step of wrapping said stretch wrap film including spirally winding said stretch wrap film about said pallet, said bottom tray, said webbing rolls, and said top cap in generally horizontal overlapping layers.

* * * * *